US009822650B2

(12) United States Patent
Guo et al.

(10) Patent No.: US 9,822,650 B2
(45) Date of Patent: Nov. 21, 2017

(54) TURBOMACHINE SHROUD

(75) Inventors: Changsheng Guo, South Windsor, CT (US); Tania Bhatia Kashyap, Middletown, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 1289 days.

(21) Appl. No.: 13/095,947

(22) Filed: Apr. 28, 2011

(65) Prior Publication Data

US 2012/0275908 A1 Nov. 1, 2012

(51) Int. Cl.
*F01D 9/04* (2006.01)
*F01D 5/28* (2006.01)

(52) U.S. Cl.
CPC ..... *F01D 9/04* (2013.01); *F01D 5/284* (2013.01); *F05D 2300/20* (2013.01)

(58) Field of Classification Search
CPC ..... F01D 5/284; F01D 9/04; F05D 2300/20
USPC ..... 415/173.4
See application file for complete search history.

(56) References Cited

U.S. PATENT DOCUMENTS

| | | | | |
|---|---|---|---|---|
| 4,884,820 | A * | 12/1989 | Jackson et al. | 277/415 |
| 5,601,402 | A | 2/1997 | Wakeman et al. | |
| 6,113,347 | A * | 9/2000 | Forrester | 415/9 |
| 6,368,054 | B1 | 4/2002 | Lucas | |
| 6,471,472 | B1 | 10/2002 | Stauder et al. | |
| 6,702,550 | B2 * | 3/2004 | Darkins et al. | 415/139 |
| 6,733,233 | B2 | 5/2004 | Jasklowski et al. | |
| 6,942,445 | B2 | 9/2005 | Morris et al. | |
| 6,997,673 | B2 | 2/2006 | Morris et al. | |
| 7,033,138 | B2 | 4/2006 | Tomita et al. | |
| 7,117,483 | B2 | 10/2006 | Dorr et al. | |
| 7,762,076 | B2 | 7/2010 | Shi et al. | |
| 7,771,160 | B2 | 8/2010 | Shi et al. | |
| 8,496,431 | B2 * | 7/2013 | Habarou et al. | 415/170.1 |

OTHER PUBLICATIONS

U.S. Appl. No. 13/006,488, filed Jan. 14, 2011.

* cited by examiner

*Primary Examiner* — Nathaniel Wiehe
*Assistant Examiner* — Brian O Peters
(74) *Attorney, Agent, or Firm* — Carlson, Gaskey & Olds, P.C.

(57) ABSTRACT

A ceramic shroud seal has a roughed inner surface for contacting a rotating turbomachine component.

24 Claims, 3 Drawing Sheets

TURBOMACHINE SHROUD

BACKGROUND

This disclosure relates generally to a turbomachine shroud, and more particularly, to a roughed inner surface of a turbomachine shroud.

As is known in the art, turbomachines extract energy from a flow of fluid. During operation, air is pulled into the turbomachine. The air is then compressed and combusted. The products of combustion expand to rotatably drive a turbine section of the turbomachine. As is known, shrouds (or outer seals) seal against rotating components (such as blades) of the turbomachine. Sealing interfaces between the rotating components and the shrouds increases engine efficiency. Current shroud designs utilize smooth inner shroud surfaces that are typically finished by diamond grinding.

Due to the shroud seal structure, the rotating components can come into contact with the inner surface of the shroud causing a "rub event". When a rub event occurs, a portion of the rotating component may rub off and can smear on or otherwise get affixed to the inner surface of the shroud. Rubbing can result in undesirable thermal conditions and a decrease in the efficiency of the turbomachine. Current designs incorporate a "no-rub" clearance zone to prevent rub events from occurring and thereby minimize thermal events. The no-rub clearance zone is an clearance, or gap, between the rotating component and the shroud assembly. No-rub clearance zones, however, reduce the effectiveness of the seal.

SUMMARY

A turbomachine has a cylindrical shroud assembly with an inner surface and an outer surface. The inner surface has a roughed ceramic surface for contacting a rotating turbomachine component.

A ceramic shroud for use with a turbomachine has a cylindrical ceramic shroud with a radially outer surface and a radially inner surface, the radially inner surface being roughed.

These and other features of the present invention can be best understood from the following specification and drawings, the following of which is a brief description.

DETAILED DESCRIPTION

Figure 1:
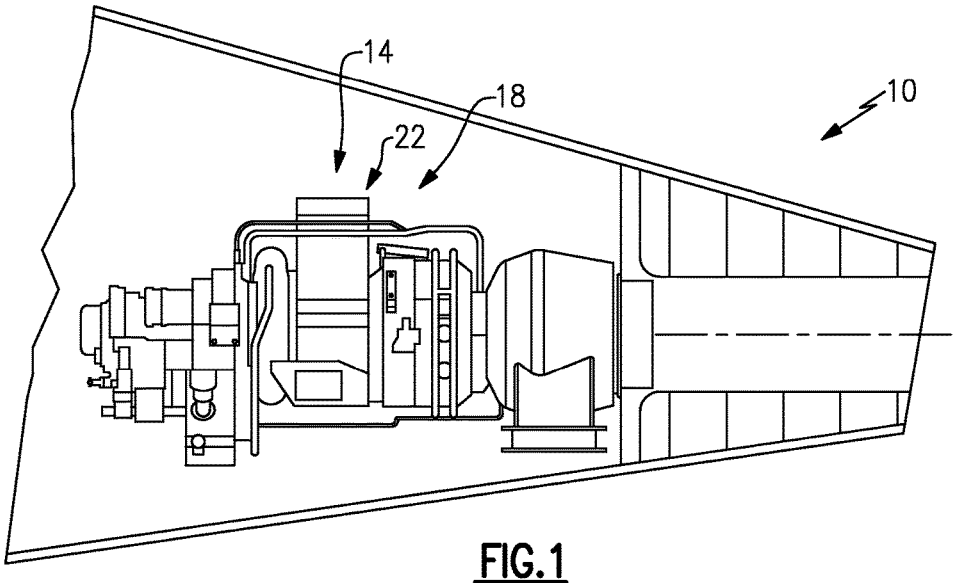
FIG. 1 illustrates a side view of an auxiliary power unit in the tail portion of an aircraft.
Figure 2:
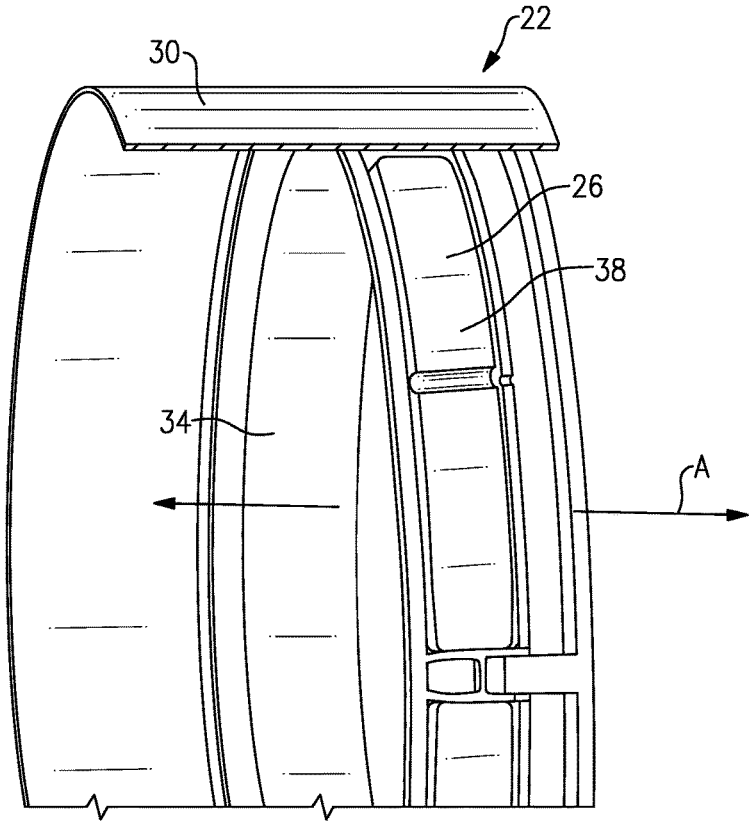
FIG. 2 illustrates a partially cut away view of the turbine section of FIG. 1.

Referring to FIG. 1, a tail section 10 of an aircraft houses an auxiliary power unit (APU) 14, which is an example type of turbomachine. The APU 14 provides power and pressurized air for use in the aircraft. Although shown in the tail section 10 of an aircraft, a person having skill in the art and the benefit of this disclosure will understand that the APU 14 could be located elsewhere within the aircraft. Alternatively, a turbomachine may be used to provide power for propulsion of an aircraft.

During operation of the APU 14, compressed air moves from a compression section 18 of the APU 14 to a turbine section 22 of the APU 14. As is known, the APU 14 includes various other components to facilitate operation.

The turbine section 22 of the APU 14 includes a shroud assembly 26 positioned within a turbine support case 30. The example shroud assembly 26 is an annular shroud that establishes an axis A. The shroud assembly 26 includes a radially inner surface 34 and a radially outer surface 38. In this example, the shroud assembly 26 is roughly cast, and then machined to finished dimensions. The example shroud assembly 26 is a monolithic ceramic structure. Alternate shroud assemblies having a metallic structure with a ceramic coating, coating at least the radially inner surface 34, can also be used with the below disclosure.

Figure 3:
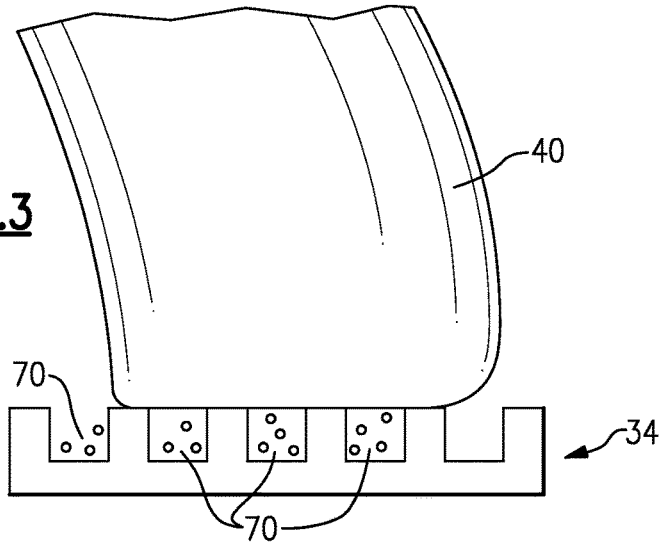
FIG. 3 illustrates a rotating component interfacing with an inner surface of a shroud assembly.

The radially inner surface 34 of the shroud assembly 26 seals against a component 40 (illustrated in FIG. 3) that rotates about the axis A defined by the shroud assembly 26. The interfacing between the inner surface 34 of the shroud assembly 26 and the rotating component 40 is illustrated in FIG. 3. By way of example, the rotating component 40 can be multiple blades in a blade array. The example inner surface 34 is a roughed inner surface that seals against the rotating component 40. When the roughed inner surface 34 contacts the rotating component 40 during a rub event, the roughed inner surface 34 abrades the rotating component 40, and also removes material imperfections as chips or flecks 70, from the rotating component 40. Removal of the chips and flecks 70 via the roughed inner surface 34 prevents buildup of a smear on the inner surface 34 caused by rub events. The presence of a smear can dramatically increase the pressure and forces between the rotating component 40 and the inner surface 34, and thermal generation during a rub event, thus the removal of chips and flecks 70 reduces thermal generation during a rub event.

Figure 4:
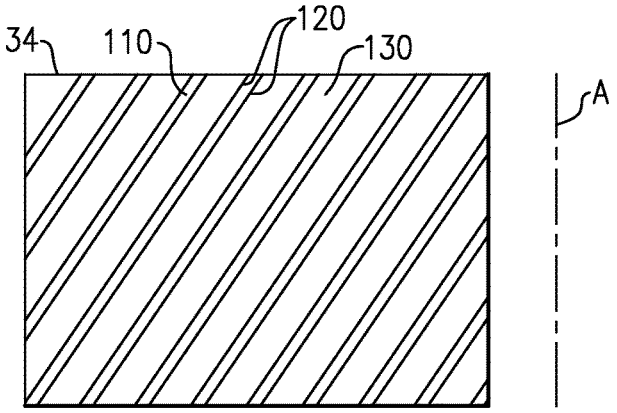
FIG. 4 illustrates a grooved, roughed, inner shroud surface.
Figure 4A:
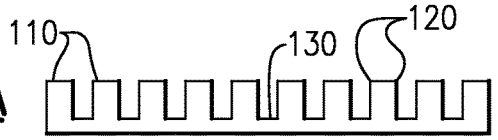
FIG. 4A illustrates a side view of an example grooved, roughed, inner surface of FIG. 4.
Figure 4B:
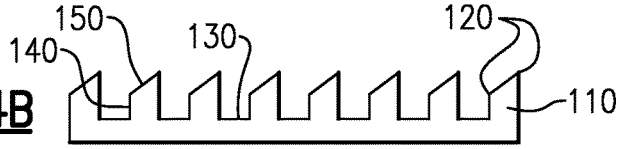
FIG. 4B illustrates a side view of another example grooved, roughed, inner surface of FIG. 4.

FIGS. 4 and 4A illustrate a first example roughed inner surface 34 of the shroud assembly 26 in a top view (FIG. 4) and a side view (FIG. 4A). FIG. 4B illustrates a side view of an alternate example roughed inner surface 34. The surface 34 has multiple grooves 130 separated from each adjacent groove 130 by a rise 110. Each of the rises 110 has two cutting edges 120 that contact the rotating component 40 during a rub event. Materials abraded from the rotating component 40 during the rub event enter the grooves 130 and is channeled out of the shroud assembly 26 along the grooves 130. Each of the grooves 130 is aligned with each of the other grooves 130 and is angled relative to the axis A defined by the shroud assembly 26. The groove's alignment prevents buildup of material from the rotating component 40 on the inner surface 34 of the shroud assembly 26.

In the alternate example of FIG. 4B, each of the cutting edges 120 on the rises 110 are not equidistant from the base of the grooves 130. The disparity in cutting edge height results in an angled radially facing surface 150. The particular angle of the radially facing surface 150 can be varied depending on the shape of the rotating component 40 interfacing with the roughed inner surface 34, and can control the amount of abrasion of the component 40 resulting from a rub event.

Figure 4C:
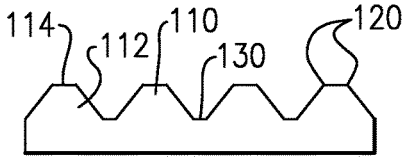
FIG. 4C illustrates a side view of another example grooved, roughed, inner surface of FIG. 4.

FIG. 4C illustrates another alternate example roughed inner surface. In the alternate example, each of the rises 110 has a wider base 112 than interfacing surface 114. The wider base 112 creates a pyramid-like structure and adds strength to the rise 110.

Figure 5:
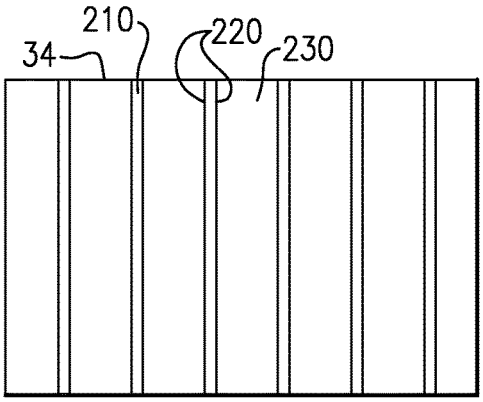
FIG. 5 illustrates another example grooved, roughed, inner shroud surface.

FIG. 5 illustrates a second example roughed inner surface 34 using the same type of grooves 230 and rises 210 as in the example of FIG. 3. FIG. 5, however, illustrates the grooves 230 and rises 210 being approximately parallel to the axis A. Whether to use an approximately parallel groove arrangement or an angled groove arrangement is a design decision that is based on design factors impacting the ability of the grooves 130 to remove chips and flecks, such as the expected rotation speed of the rotating component 40 and the anticipated frequency of rub events.

The rises 110, 210 and grooves 130, 230 of FIGS. 4, 4A, 4B and 5 are machined into the ceramic inner surface 34 of the shroud assembly 26 using diamond grinding with a thin grinding wheel, a wire saw, laser etching, etc. In each of these roughing techniques, the grooves 130, 230 are cut out of the smooth ceramic surface, thereby ensuring that the cutting edges 120, 220 of the rises 110, 210 are sharp.

The rises 110, 210 on the ceramic inner surface 34 of the shroud assembly 26 are minimally degraded by a rub event and thus, the shroud assembly 26 has an increased product life.

Figure 6:
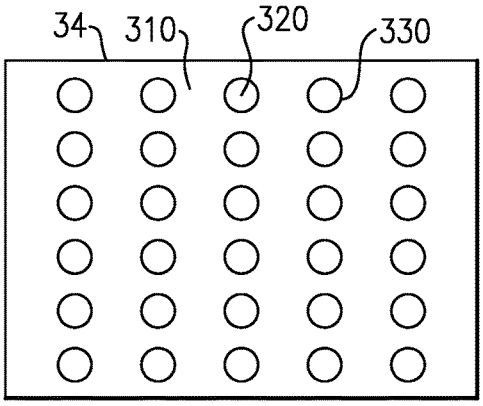
FIG. 6 illustrates a roughed inner shroud surface having ordered peaks separated by a valley.
Figure 6A:
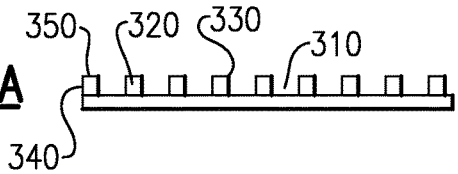
FIG. 6A illustrates a side view of the roughed inner surface of FIG. 5.

FIGS. 6 and 6A illustrate a peak and valley roughing configuration that is utilized as an alternative to the rises and grooves of FIGS. 4, 4A, 4B, and 5. FIG. 6 illustrates a top view of the peaks and valleys, while FIG. 6A illustrates a single view. In peak and valley roughing arrangements, the ceramic surface 34 includes multiple peaks 320 each of which has a sharp cutting edge 330 defined by a meeting of an axially facing surface 340 and a radially facing surface 350, where the radially facing surface is the top of the peak 320. In one exemplary embodiment, the top of the peak 320 is a planar surface.

FIGS. 6 and 6A illustrate an example roughed surface 34 having ordered peaks 320 separated by a single contiguous valley 310. The particular arrangement of peaks 320 depicted in FIGS. 6 and 6A is exemplary only, and can be altered to suit the needs of any given shroud application. The patterned peaks 320 and valley 310 are cut into the inner surface 34 of the ceramic shroud assembly 26 using a grinding technique, a laser etching technique, or any other suitable machining technique, and allow for tight clearances in the design of the shroud assembly 26. As an alternative to the illustrated single contiguous valley 310, multiple disconnected valleys 310 could be used to similar effect.

Figure 6B:
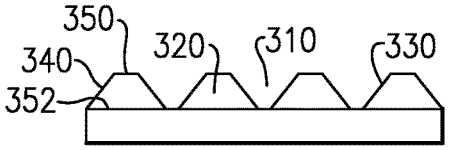
FIG. 6B illustrates a side view of an alternate example of the grooved, roughed, inner surface of FIG. 5.

FIG. 6B illustrates an alternate example roughed surface 34. In the example of FIG. 6B, each of the peaks 320 has a radially facing surface 350 at the top of the peak 320, and a base 352. The base 352 is wider than the radially facing surface 350 creating a pyramid-like structure.

Figure 7:
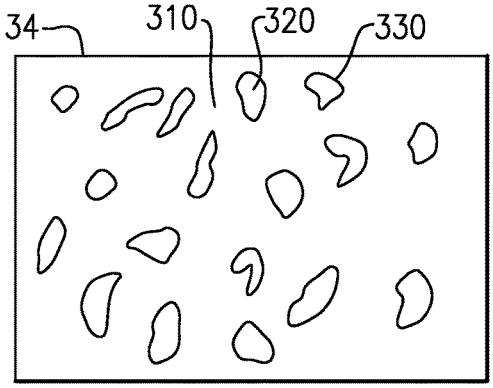
FIG. 7 illustrates a roughed inner shroud surface having random peaks separated by a valley.

FIG. 7 illustrates an alternate peak and valley configuration having random peaks 320 separated by at least one valley 310. The peaks 320 and valley 310 are carved from the inner surface 34 of the ceramic shroud assembly 26 by carving out the valley 310 from the smooth ceramic inner surface 34 using crush grinding or grit blasting. A random peak configuration such as the one presented in FIG. 7 is less expensive to create than the patterned peak and valley configuration of FIGS. 6, 6A, and 6B as crush grinding and grit blasting are less expensive than the precision machining methods used to create an ordered peak arrangement of FIGS. 5 and 5A.

In each of the examples of FIGS. 6, 6A, 6B and 7, the peak 320 has a cutting edge 330 that defines the top of the peak 320. During a rub event, the rotating component contained sealed with the shroud rubs against the cutting edge 330 of each of the peaks 320, and the cutting edges 330 abrades the rotating component 40. The chips or flecks abraded from the rotating component by the peak cutting edges 330 are removed to the valley 310, and are thus removed from contact with the rotating component 40. In this way, thermal generation from a rub event causing damage to the rotating component 40 or the shroud assembly 26 is reduced.

In each of the roughing patterns described above, the cutting edges 120, 220, 330 are self sharpening ceramic edges. Due to the brittle properties of the ceramic shroud assembly 26, the cutting edges 120, 220, 330 microscopically break down during a rub event. The microscopic breakdown functions like a self sharpening whetstone, and acts to keep a sharp, abrasive, edge on the peaks 320 and rises 110, 210 thereby ensuring that the cutting capability is maintained through multiple rub events.

It is additionally understood that each of the above-described roughing techniques can be combined with one or more of the other described roughing techniques to create a hybrid roughed surface and still fall within this disclosure, and that the roughing techniques described above are equally applicable to shrouds having a ceramic coating.

Although an example embodiment has been disclosed, a worker of ordinary skill in this art would recognize that certain modifications would come within the scope of this disclosure. For that reason, the following claims should be studied to determine the true scope and content of this disclosure.

What is claimed is:

1. A turbomachine comprising:

a cylindrical shroud assembly having an inner surface and an outer surface;

wherein said inner surface comprises a roughed ceramic surface for contacting a rotating turbomachine component;

said roughed ceramic surface comprises a plurality of raised portions protruding radially inward from said inner shroud surface toward an axis defined by said shroud assembly, said raised portions are arranged in a random arrangement across said roughed ceramic surface; and wherein said plurality of raised portions and said cylindrical shroud assembly are a monolithic ceramic piece.

2. The turbomachine of claim 1, wherein said roughed ceramic surface comprises a ceramic coating.

3. The turbomachine of claim 1, wherein said roughed ceramic surface and said plurality of raised portions are comprised of a single material.

4. The turbomachine of claim 1, wherein each of said raised portions comprises at least one cutting edge, for abrading a rotating turbomachine component.

5. The turbomachine of claim 4, wherein each of said cutting edges comprises a self sharpening ceramic edge.

6. The turbomachine of claim 4, wherein said cutting edge is defined by a joint between an axially facing surface of one of said raised portions and a radially facing surface of said one of said raised portions.

7. The turbomachine of claim 6, wherein said raised portions interface with said rotating turbomachine component at said radially facing surface.

8. The turbomachine of claim 4, wherein each of said raised portions comprises a rise separated from at least one adjacent rise via a groove.

9. The turbomachine of claim 8, wherein each of said rises is approximately parallel to an axis defined by said shroud assembly.

10. The turbomachine of claim 8, wherein each of said rises is at an angle to an axis defined by said shroud assembly, and is aligned with each other rise.

11. The turbomachine of claim 8, wherein each of said rises comprises two cutting edges.

12. A shroud for use with a turbomachine comprising:

a cylindrical shroud having a radially outer surface and a radially inner surface;

wherein said radially inner surface comprises a plurality of raised elements protruding radially inward from an inner shroud surface toward an axis defined by the ceramic shroud;

wherein said plurality of raised elements are arranged about the inner surface randomly; and wherein said roughed ceramic surface, said plurality of raised portions, and said cylindrical shroud are a monolithic ceramic piece.

13. The shroud of claim 12, wherein each of said raised elements comprises at least one cutting edge.

14. The shroud of claim 12, wherein said at least one cutting edge is defined by a joint between a radially facing surface of one of said raised elements and an axially facing surface of said one of said raised elements.

15. The shroud of claim 12, wherein said cutting edge comprises a self sharpening cutting edge.

16. The shroud of claim 12, wherein each of said plurality of raised elements is separated from each other of said plurality of raised elements via a contiguous valley.

17. The shroud of claim 12, wherein said radially inner surface comprises a ceramic coating.

18. The shroud of claim 12, wherein said shroud is a ceramic shroud.

19. The shroud of claim 12, wherein said roughed ceramic surface and said plurality of raised portions are comprised of a single material.

20. The shroud of claim 12, wherein each of said raised elements is isolated from at least one adjacent raised element via a groove.

21. The shroud of claim 20, wherein each of said raised elements is at least partially aligned with each other of said raised elements.

22. A method for reducing thermal generation during a rub event between a shroud assembly and a rotating component, comprising:

establishing a roughed inner surface of said shroud assembly, said roughed inner surface comprising a plurality of raised portions protruding radially inward from said inner shroud surface toward an axis defined by said shroud assembly;

wherein said plurality of raised elements are arranged about the inner surface randomly; and wherein said roughed ceramic surface, said plurality of raised portions, and said shroud are a monolithic ceramic piece.

23. The method of claim 22, wherein said plurality of raised portions abrade a rotating component during a rub event.

24. The method of claim 22, wherein said roughed ceramic surface and said plurality of raised portions are comprised of a single material.

* * * * *